United States Patent [19]

Rich

[11] Patent Number: 4,573,752

[45] Date of Patent: Mar. 4, 1986

[54] FLAT CABLE CONNECTION SYSTEM

[75] Inventor: Donald S. Rich, Long Valley, N.J.

[73] Assignee: Parlex Corporation, Methuen, Mass.

[21] Appl. No.: 596,543

[22] Filed: Apr. 4, 1984

[51] Int. Cl.[4] ..... H01R 9/07

[52] U.S. Cl. ..... 339/17 F; 339/99 R; 339/103 M

[58] Field of Search ..... 339/17 F, 176 MF, 17 LC, 339/17 L, 103 M, 103 R, 99 R

[56] References Cited

U.S. PATENT DOCUMENTS

| | | | |
|---|---|---|---|
| 3,275,968 | 9/1966 | McCaughey | 339/176 MF |
| 3,278,887 | 10/1966 | Travis | 339/17 F |
| 3,333,229 | 7/1967 | Dean et al. | 339/176 MF |
| 3,366,919 | 1/1968 | Gammel, Sr. et al. | 339/17 F |
| 3,696,319 | 10/1972 | Olsson | 339/17 F |
| 4,061,405 | 12/1977 | Minter | 339/17 M |

OTHER PUBLICATIONS

IBM Bulletin, Martin, vol. 4, No. 5, p. 33, Oct. 1961.

*Primary Examiner*—Neil Abrams

*Attorney, Agent, or Firm*—Weingarten, Schurgin Gagnebin & Hayes

[57] ABSTRACT

A narrow-pitch flat cable connector for use in connection of flat cables to printed circuit boards or other substrates includes wireform or prestamped female contacts on the same narrow pitch as that of the cable conductors and a connector housing with contact-receiving slots on the same narrow pitch as that of the cable conductors. The female contacts have U-shaped forward portions and in one embodiment are mounted in staggered offset relationship to the printed circuit board to present contacts at the same narrow pitch established by the narrow pitch of the conductors in the cable. The cable is terminated with a connector housing having a lateral cable insertion channel and vertical pairs of contact-receiving slots communicating with the cable insertion channel and aligned with the conductors of the cable. In one embodiment, the contact-receiving slots have different depths depending on which side of the cable electrical contact is to be made, thereby permitting double-sided contact to the cable, with the different depths and the insertion channel configuration providing a shelf to the side of the cable opposite that to which electrical contact is made. In one embodiment, an insulation displacing connector stamping is utilized which removes insulation from the conductors of the cable to permit contact to the cable. In a further embodiment, a specialized U-shaped removable transverse strain relief member is provided.

12 Claims, 8 Drawing Figures

FLAT CABLE CONNECTION SYSTEM

FIELD OF INVENTION

This invention relates to electrical connectors and more particularly to electrical connectors for narrow-pitch flat cables.

BACKGROUND OF THE INVENTION

The termination of flat cables has, in the past, been accomplished in the main through the techniques of soldering, crimping and insulation displacement. Soldering is both expensive and, with a fine cable pitch, is subject to bridging, shorting, or delamination. Crimping has not been practical on a pitch less than 0.05 inches. This is a result of the footprint size of a crimped joint in which adequate metal cold flow occupies significant real estate. For gas-tight insulation displacement connection in which pointed, jawed contacts pierce a thin flat cable from a direction orthogonal to the flat top or bottom surface of the cable, the problem is that the cable is only contactable from one side. One such insulation displacing connector is the telephone modular jack connector commonly employed for three and four pair telephone cables. Note when the term "pitch" is used herein, pitch is defined as the center-to-center spacing of the ends of the conductors in the cable.

More recently, single-sided flat cables have been manufactured with conductors having a pitch of less than 0.050 inches and cable connection systems for such cables involve soldering, crimping and the use of the common telephone modular plugs. For the purposes of this patent, a cable having a conductor pitch of less than 0.05 inches is considered to be a narrow-pitch cable. Note, for narrow-pitch cables the connection systems to date have been single-sided. Telephone cable requirements now envision a two-sided cable having a pitch of 0.0425 inches which involves too small a space to be accommodated by standard single-sided flat cable connectors. As the number of conductors per inch increases, with concomitant decrease in pitch, there is a need for a connector which can accommodate such small pitches without the necessity of converting the position of the conductors to a more spread out or fanned out pattern in order to effectuate proper connection.

Thus, while it is indeed possible to make some sort of connection to flat cables of such small pitch, the connectors associated with the small-pitch cables in general either are single-sided or rely on internal electrical paths within the connector body which fan out or spread out the conductor paths, such that oversized mating male or female conductors must be utilized. With a drive to miniaturization, especially in providing narrow cables, it is desirable to provide a connector which has a connector body having connector contact paths or channels which do not utilize the fan out approach in order to provide for appropriate connection.

Likewise, when such cables are to be connected to printed circuit boards it is desirable to minimize the amount of circuit board real estate utilized when mounting contacts to the printed circuit board. The limiting factor is primarily the hole spacing between the holes utilized to accommodate the leads of the contacts which pass through the holes and are soldered to the printed circuit board by conventional wave soldering or other techniques. The limit to the lateral spacing of the holes relates to the amount of dielectric material between the hole pads to insure against sorting or other failures. In general, for pitches of 0.0425 inches, the lateral spacing of printed circuit board holes leaves too little dielectric material between the holes when the holes are patterned in a straight line.

A further problem with ultra-thin flat cables which may be on the order of 0.024 inch thickness is that connectors which attempt to resiliently contact such cables have insufficient resilience due to the thinness of the cable. For instance, wireform contact clips such as commercially available from Digiclip Corporation of Denville, N.J. are in general utilized for connecting one circuit board to another. The gaps in the openings of these clips are generally on the order of 0.058 inches, which accommodates the typical thickness of a printed circuit board. However, when attempting to utilize commercially available clips with respect to ultra-thin cables, the spring properties of such wires are insufficient when the gaps in the clips are brought down to the 0.024 inch spacing required for the ultra-thin cables. Thus, it is impossible to utilize such clips to connect directly to the ultra-thin flat cables. Note, for purposes of this patent, "ultra-thin" refers to flat cables having a thickness less than 0.030 inches.

As mentioned before, one of the further drawbacks with respect to the aforementioned telephone type modular male connectors is that they are only capable of connecting to conductors from one side of the cable. It is only with difficulty that these connectors can be utilized for those cables in which is it desirable to contact some of the conductors from one side of the cable, while contacting other of the conductors from the other side of the cable. Such cables in which connection to conductors is to be made from alternating sides of the cable are those cables in which some sort of shield is placed or embedded between adjacent conductors or conductor pairs within the cable. Should a cable have a shield placed to one side of a conductor, then contact to this conductor must be made from the side of the cable away from the shield. Should a conductor be placed on the other side of the embedded shield, then connection to this conductor must be made from an opposite side of the cable, a situation which is accommodated only with great difficulty in terms of the aforementioned modular male connector.

A further problem associated with the utilization of ultra-thin cables is that the amount of dielectric insulation associated with these cables is exceedingly small. Thus, contacts which in any way cut through or displace such insulation are confronted with dielectric isolation problems in which electrical breakdown can easily occur in such fragile structures. Thus, any connector which can add dielectric thickness to the relatively thin cable, increases the dielectric strength of the cable-connector combination which is of obvious desirability.

In summary, for thin narrow-pitch flat cables there is a requirement for double sided connection to the cable in which real estate on the associated printed circuit board is to be minimized and in which the size of the ultimate connector is also to be minimized. Thus, the aforementioned fanned or expanding conductor structure within a connector body is to be avoided. The production of such a connection system which can maintain the relatively small pitch of the cable should also desirably include means for increasing the dielectric strength of the connector, thereby to prevent dielectric breakdown when the thin fragile cables are terminated and connected to printed circuit boards. Finally, there must be some accommodation to the relatively thin nature of the cable to permit ohmic contact to be made by relatively large-apertured spring-loaded contacts. All of the above must be accomplished without substantially altering the relatively narrow pitch established by the cable, such that real estate on the printed circuit board or other substrate is minimized in the lateral direction, and such that the original pitch established by the cable is not enlarged by the connection to the printed circuit board or substrate.

SUMMARY OF THE INVENTION

A narrow-pitch flat cable connector system for use in the connection of thin flat cables to printed circuit boards or other substrates is characterized in that all electrically conducting parts have the same pitch as the narrow cable pitch. In one embodiment, the system includes as the male member a connector housing having pairs of vertically displaced contact-receiving slots, with the cable carried in a lateral cable insertion slot or channel in the housing. As will be described, selected contact-receiving slots communicate with the cable insertion channel so that selected stripped cable ends are exposed in the contact-receiving slots. The female portion of the system includes a number of wireform or prestamped contacts mounted in staggered offset relationship to the printed circuit board to present U-shaped contact ends to the contact-receiving slots in the connector housing at the required narrow pitch established by the narrow pitch of the conductors in the cable. The offsetting of the contacts permits closer spacing of the contacts laterally across the printed circuit board or other substrate. The contacts have a U-shaped opening, and in a preferred embodiment, have tips which project inwardly towards the centerline of the U-shaped opening.

With respect to the cable termination, the connector housing or body is provided with the aforementioned lateral cable insertion channel to accommodate the insertion of the end of the cable. In one embodiment the cable is prestripped with the stripped end of the cable providing male contact pads within the connector housing. In an insulation displacing connector embodiment the end of the cable is not stripped, but rather is stripped when the prestamped contacts are inserted into the contact-receiving slot of the connector housing, with the unstripped cable already inserted into the connector housing. In general, the contact-receiving slots are vertically disposed and perpendicular to the cable insertion channel and run to the face of the connector body to receive the wireform or prestamped contacts. Selected contact-receiving slots extend down to the top and bottom surfaces of the inserted cable and communicate with the cable insertion channel to the top or bottom side at which connection is to be made to a cable conductor. For this purpose, in one embodiment, the contact-receiving slots have different depths depending on which side of the cable electrical contact is to be made, thereby permitting double-sided contact to the cable. With respect to the side of the cable to which no electrical contact is to be made for a given conductor, the connector housing is provided with a shelf to one side of the end of the cable, thereby adding thickness to the thin cable such that when the contacts are inserted into the aforementioned contact-receiving slots the shelf adds sufficient thickness to the cable to permit tight contact between the wireform or prestamped contacts and the exposed cable conductor ends. Support of the cable end at a shelf permits a contact to grab both a cable conductor and a portion of the connector body immediately thereunder for increased structural rigidity and ohmic contact. In an insulation displacement embodiment described hereinafter, the shelf also serves to protect the nonconductor side of the cable during insulation displacement of the conductor side. The shelf also increases the overall dielectric thickness to prevent dielectric breakdown and thus permits the use of thin cables in higher voltage environments.

In one embodiment, an insulation displacing connector stamping is utilized which removes insulation from the conductors of the cable to permit contact to theconductors.

In a further embodiment, a specialized strain relief member is utilized which is inserted into a slot or channel running transverse to the connector housing, with the strain relief member generally including a U-shaped cross-section and having a bottom surface which runs substantially transverse to the entire width of the cable to provide a uniform strain relief force across the entire width of the cable. The U-shaped cross-section of the strain relief member permits the sides of the strain relief member to be bent inwardly for removal of the strain relief member. One of the sides includes a detent which cooperates with an aperture in the connector housing such that the strain relief member is retained in the connector housing when pushed into its slot. The strain relief member is removed by squeezing its sides together such that the detent is removed from the aforementioned aperture.

In a still further embodiment, the contact ends are angled at a predetermined angle such that the connector housing is oriented at this angle with respect to the plane of the printed circuit board, thereby providing that shear forces are experienced by the insertion and removal of the connector housing, as opposed to compressional or tensional forces which tend to deleteriously affect the solder joint utilized to secure the contacts to the printed circuit board.

BRIEF DESCRIPTION OF THE DRAWINGS

These and other features of the subject invention will be better understood in connection with the detailed description taken in conjunction with the drawings of which.

DETAILED DESCRIPTION OF THE DRAWINGS

Figures 1, 2, 5:
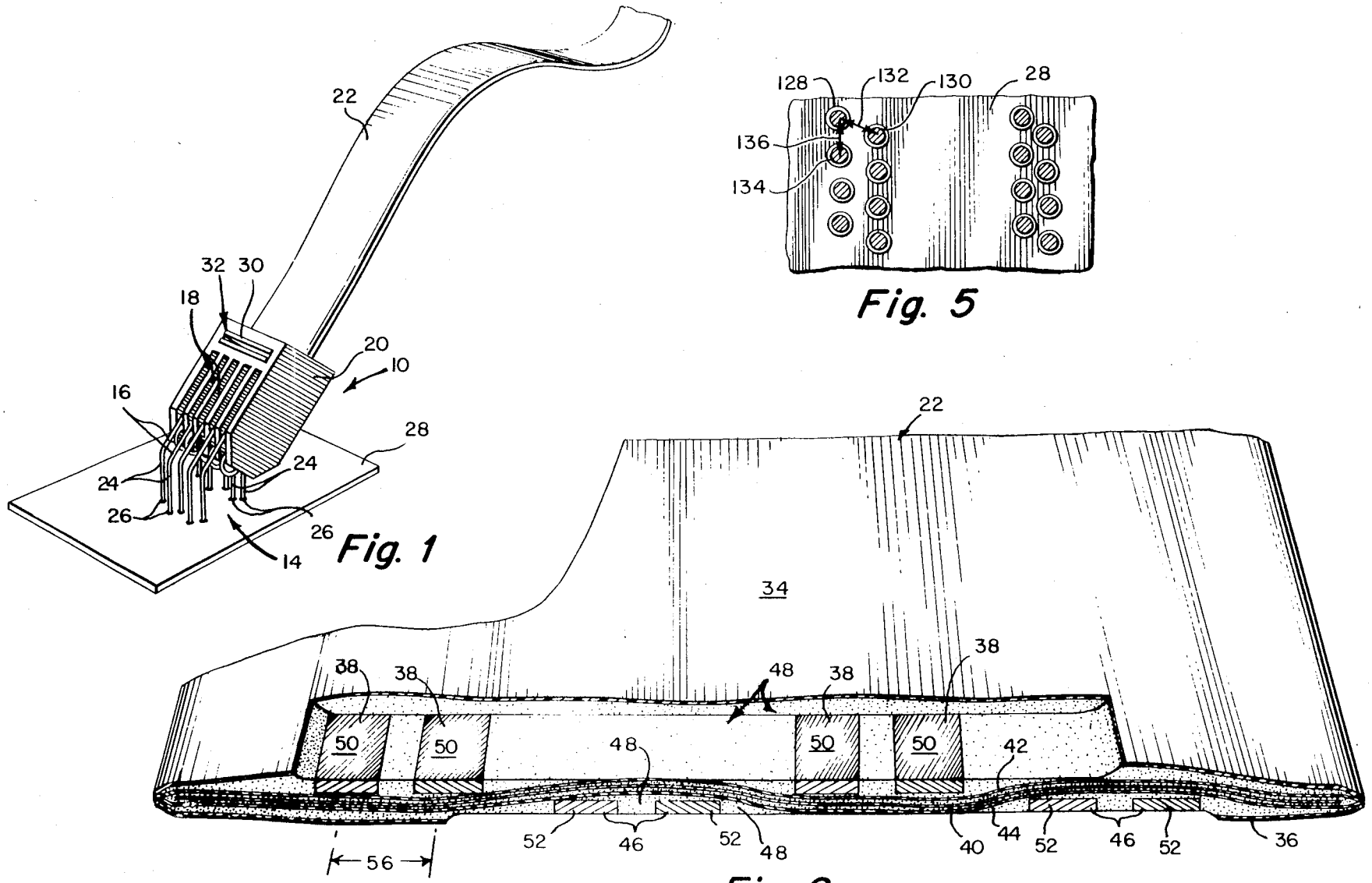
FIG. 1 is a diagrammatic illustration of the subject connector system illustrating the offset contacts and the slotted connector body to which is attached a flat narrow-pitch cable.
FIG. 2 is a diagrammatic illustration of the end of the cable of FIG. 1 showing the end of the cable stripped to expose conductors on two sides thereof.
FIG. 5 is a bottom view of the printed circuit board of FIG. 4 illustrating the offset through-holes thereof.

Referring now to FIG. 1, a connection system generally indicated by reference character 10 includes a number of offset contacts 14 having U-shaped portions 16 which are inserted into pairs of vertically displaced channels or contact-receiving slots 18 in a connector housing 20 which accommodates a cable 22 therein. Contacts 14 have leads 24 which penetrate through-holes 26 in a printed circuit board 28 which forms a contact carrier. The contact carrier can be of any type which maintains the position of the wireform contact, and as such may be either a printed circuit board or a portion of a flex circuit, a flexprint cable or indeed any type of substrate whatsoever. As illustrated in this diagram, connector housing 20 includes a slot 30 into which is positioned a strain relief member generally indicated by reference character 32 which maintains cable 22 in place within connector housing 20.

Referring to FIG. 2, cable 22 may be of a double-sided design which includes a top outer envelope or skin 34 and a bottom outer envelope or skin 36, with top pairs of conductors 38 embedded in the cable along with an internal electromagnetic and/or electrostatic shield 40 which is surrounded by insulating layers 42 and 44. The shield may be of any electrostatic or electromagnetic type of foil or metal, whereas the insulating layers may be, for instance, mylar. Bottom sets of conductors 46 are shown as illustrated with the top conductors and the bottom conductors being exposed via a grinding or abrading operation which cuts through the envelope surrounding the cable and through the adhesive generally indicated by reference character 48 to expose top surfaces 50 of conductor pairs 38 and bottom surfaces 52 of conductor pairs 46.

As illustrated in FIG. 2 the flat cable is a double-sided cable in that conductors therein are to be contacted from one surface or the other of the cable. This means that conductors 38 are to be contacted from the top surface of cable 22, whereas conductors 46 are to be contacted from the bottom of this cable.

The pitch of this cable is illustrated by double-ended arrow 56 to be the centerline-to-centerline distance between adjacent conductor ends within the cable. This cable can also be characterized by the fact that the conductor pairs are laterally offset and are contactable from different sides of the cable.

The cable of FIG. 2 is presented for illustration purposes only, it being understood that single-sided cables with or without shields are within the scope of this invention, as are double-sided cables with or without internal embedded shields. It will also be appreciated that the shield of FIG. 2 is, in general, bonded together in a lamination process through the utilization of a heat-activated adhesive which is a dielectric insulator that is interposed between the various components of the cable.

Figure 3:
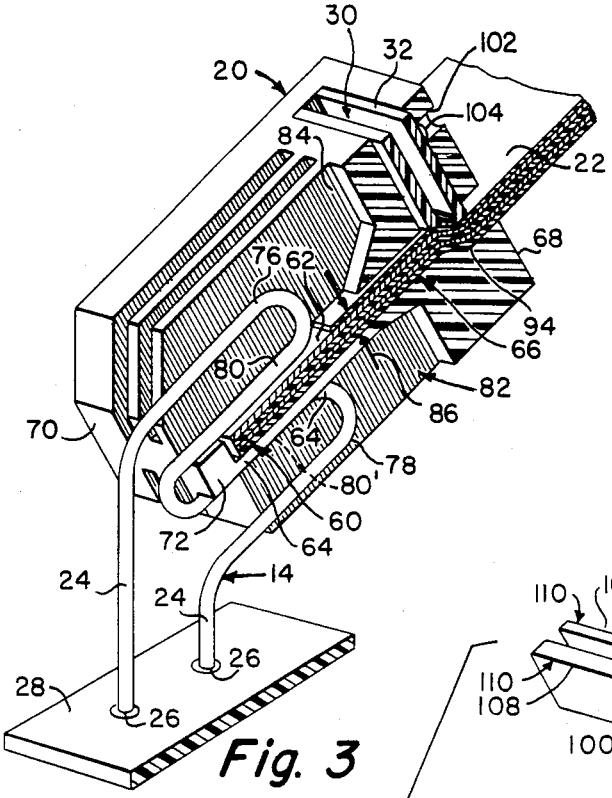
FIG. 3 is a diagrammatic and cross-sectional illustration of the subject connection system illustrating a wireform contact surrounding a stripped end of a flat cable inserted into a connector body, illustrating the pairs of vertically displaced contact-receiving slots or channels communicating with the cable insertion channel, along with the position of the releasable strain relief member.

Referring to FIG. 3, cable 22 which has been stripped in accordance with the teaching of FIG. 2 is inserted into conductor housing 20. The stripped cable end generally illustrated at 60 is shown to have an exposed conductor 62 and is shown to ride on a shelf 64 which is the bottom surface of a cable introduction channel generally indicated at 66 which runs from the posterior end 68 of housing 20 towards the face 70 of connector housing 20, with the cable introduction channel being generally lateral in nature and stopping short of face 70 at an abutment portion 72 at face 70. Alternatively, channel 66 can run completely through the connector housing.

Exposed conductor 62 is contacted via a wireform contact 14 which as illustrated has ends or arms 76 and 78 which constitute a U-shaped portion 80 and 80′, with portion 80 contacting the top surface of exposed conductor 62 and with the bottom portion 80′ contacting the underside of shelf 64. The underside of shelf 64 is formed by slot 82 which is one of a pair of contact-receiving slots. The associated slot of the pair is slot 84 which communicates with channel 66 at the portion of the channel adapted to expose the conductor of the cable to be contacted. It will be seen that the contact-receiving slots which are the deepest are those which communicate with cable insertion channel 66, whereas the opposing less deep slots communicate below the channel leaving shelf 64. In a preferred embodiment, the contact-receiving slots are vertically displaced, although they could be displaced at any angle with respect to channel 66 other than zero.

It will be appreciated that shelf 64 increases the thickness of the cable indicated by arrows 86 by an amount sufficient to permit the spring force of wireform 14 to grip onto the relatively thin cable. The thickness of shelf 64 is determined by the depth of slot 82 and can be made to accommodate standard wireforms such as manufactured by Digiclip Corporation.

Figure 4:
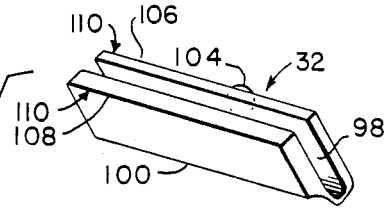
FIG. 4 is a diagrammatic illustration of the connector housing and cable of FIG. 3 illustrating the offset nature of the contacts on a printed circuit board and their relationship to the variable depth slots in the connector body.
Figure 4:
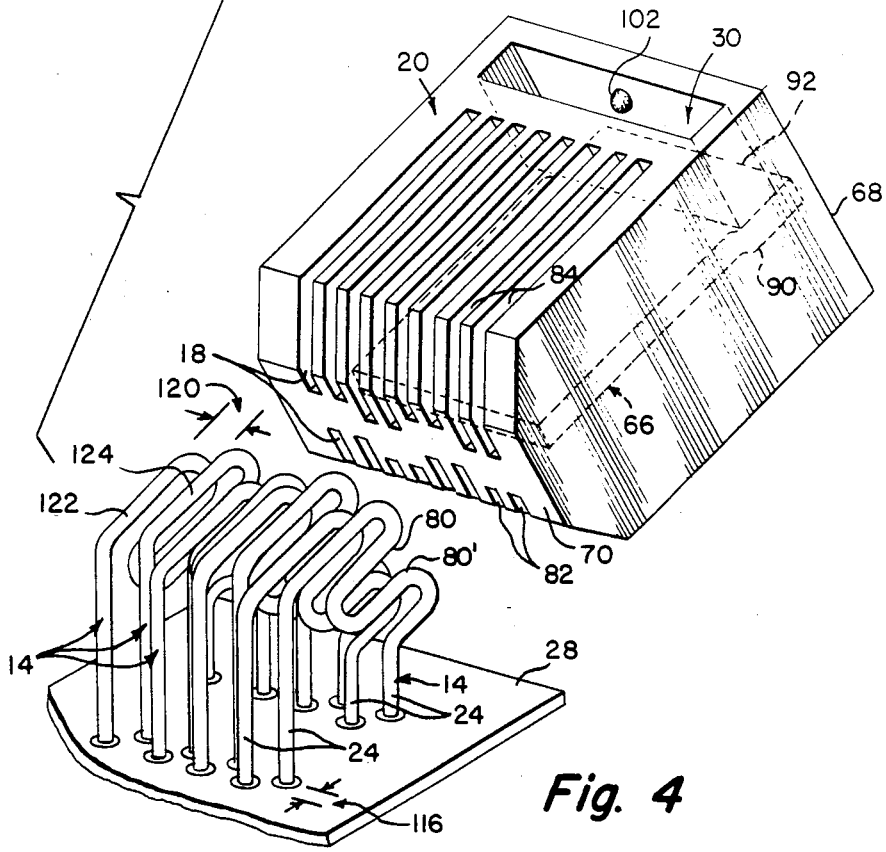

Referring to FIG. 4, in one embodiment cable insertion channel 66 is shown in dotted outline with a change in plane at 90 such that the cable enters entrance slot 92 in end 68 and is then projected up around shoulder 94 to the level at which it is to be contacted. Alternatively, channel 66 may occupy only one plane. In the illustrated embodiment, when fully inserted as illustrated in FIG. 3, strain relief member 32 is inserted into slot 30 to clamp the cable to shoulder 94, thereby to prevent its removal. As illustrated in FIG. 4 strain relief member 32 is U-shaped having a U-shaped channel 98 therein and an elongated transverse edge 100 which, when the strain relief member is inserted into channel 30, provides a uniform strain relief pressure across cable 22 which is inserted into channel 66 over shoulder 94. Note that in a preferred embodiment the bottom edge of the strain relief member conforms to the shape of shoulder 94. It will be appreciated referring to FIG. 3 that housing 20 carries an aperture 102 and that strain relief member 32 has a detent 104 which is adapted to fit into aperture 102 when the strain relief member is fully inserted into its associated slot. Removal of the strain relief member is accomplished by bending sides 106 and 108 inwardly together in the direction of arrows 110, thereby removing detent 104 from aperture 102.

Referring again to FIG. 4, the different depths of the contact-receiving slots 18 can be seen. Here, for instance, the difference between the depth of slot 84 and slot 82 can be easily recognized. In the embodiment shown, the connector body is slotted to accommodate a double-sided cable such as illustrated in FIG. 2 which includes pairs of cables. Thus, laterally adjacent pairs of slots have an identical pattern for the adjacent pairs of conductors, with the slot pattern being alternated for the underside conductor pairs so as to permit contact to the conductor pairs on the opposite side of the cable.

As illustrated, contacts 14 are aligned with the associated contact-receiving slots in connector housing 20. Also illustrated in FIG. 4 is an offset illustrated by arrows 116 between the leads 24 of adjacent contacts. The offsetting of the adjacent contacts permits sufficient dielectric material to be interposed between the leads of adjacent contacts to permit the contacts to be positioned close enough to match the narrow pitch of the conductors of the cable to which they are to be connected. Thus, for instance, the pitch as illustrated by double-ended arrows 120 of adjacent contacts 122 and 124 is such as to match the original pitch of the conductors within the cable, with the pitch of slots 82 and 84 also being identical to the pitch established by the conductors of the cable.

Referring to FIG. 5, the underside of printed circuit board 28 is illustrated to indicate that the length of dielectric between, for instance, apertures 128 and 130 as given by double-ended arrow 132 can be made clearly longer than if there were no offset between adjacent contacts. Thus, for instance, if the pitch to be maintained is 0.0425 inches and if the contacts were to be arranged side by side with no offset, there would be insufficient distance between apertures, hole pads or annular rings in the printed circuit board to maintain dielectric isolation between the contacts. However, by staggering the contacts in the manner illustrated in connection with FIGS. 1, 4 and 7, sufficient dielectric material can be maintained between the leads of the adjacent contacts while still maintaining the required very narrow pitch.

Not only is the distance between adjacent contacts as illustrated by arrow 132 clearly in excess of that which would be possible without offset, the distance between aperture 128 and aperture 134 as illustrated by double-ended arrow 136, is also clearly in excess of that which would be available were the contacts not offset.

Referring back to FIG. 4, while the offsetting of the contacts is necessary in one embodiment to maintain the very small pitch established by the cable, it will be appreciated that the ends of the wireforms are not in a single plane. While the individual wireforms could be foreshortened or lengthened so that ends of the contacts adjacent the connector housing would be in a single plane, this is not necessary because, as will be appreciated from viewing FIG. 3, there is a substantial length of exposed conductor of the cable which may be contacted by the wireform contact. Thus, the foreshortening or lengthening of adjacent contacts is of relative unimportance with respect to maintaining proper ohmic contact with the exposed conductors of the cable inserted into connector housing 20. it will also be appreciated that if single-sided contact is all that is required, then the pairs of contact-receiving slots need not have the alternating structure illustrated in face 70 of housing 20. Likewise, if individual conductors, as opposed to conductor pairs, are to be accommodated, then the slot pairs in housing 20 can be configured accordingly. For instance, if a three-wire configuration or three-conductor configuration were to be preferred, then the three adjacent contact-receiving slot pairs would be of the same configuration, whereas the next three adjacent slot pairs, assuming a double-sided cable, would be of an inverted configuration. The configuration of the contact-receiving slot pairs is therefore defined by the particular cable which is to be accommodated.

Figure 6:
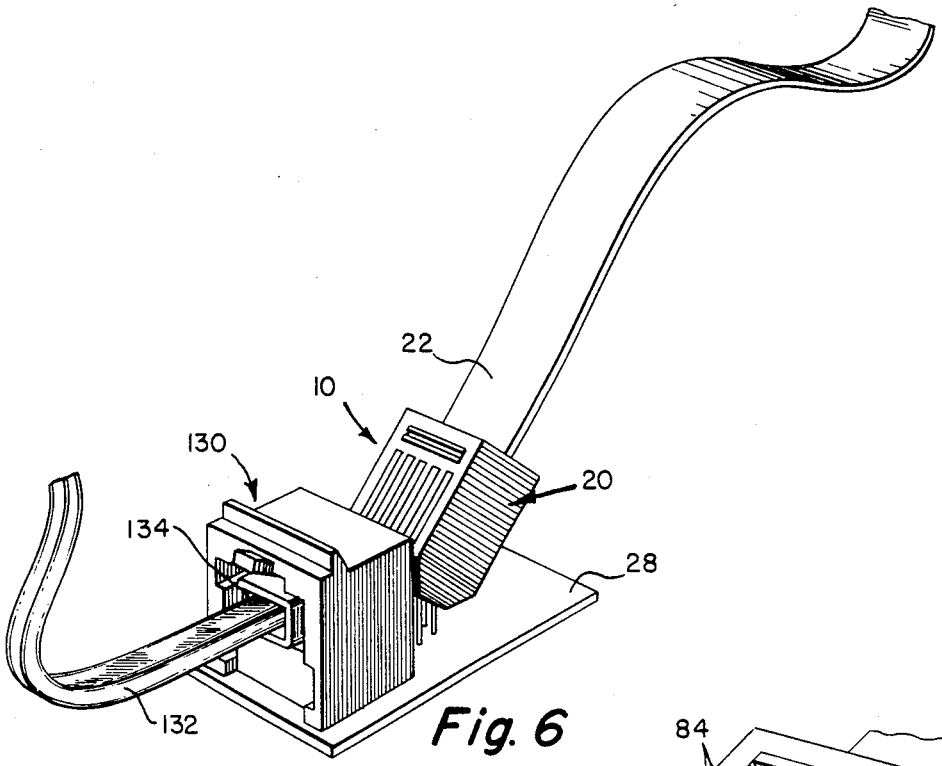
FIG. 6 illustrates an under carpet embodiment for the connector system of FIGS. 1–5 in which a standard telephone connector jack is mounted to the printed circuit board such that the cable may run underneath a carpet or like device and be connected to a standard modular connector.

Referring now to FIG. 6, the connector system of FIG. 1 may be utilized to connect cable 20 to a standard modular telephone connector 130 which is mounted to printed circuit board 28 in any conventional manner. This permits the utilization of flat cable 22 underneath carpeting, etc., with the connection of this flat cable to a standard cable 132 via a standard jack 134 and connector 130. In this embodiment, the printed circuit board, the contacts, and the connector body constitute an interface between cable 22 and standard jack 130 so that flat cables may be rapidly interfaced with standard telephone apparatus and used extensively where flat cabling is required.

Insulation Displacing Connector System

Figure 7:
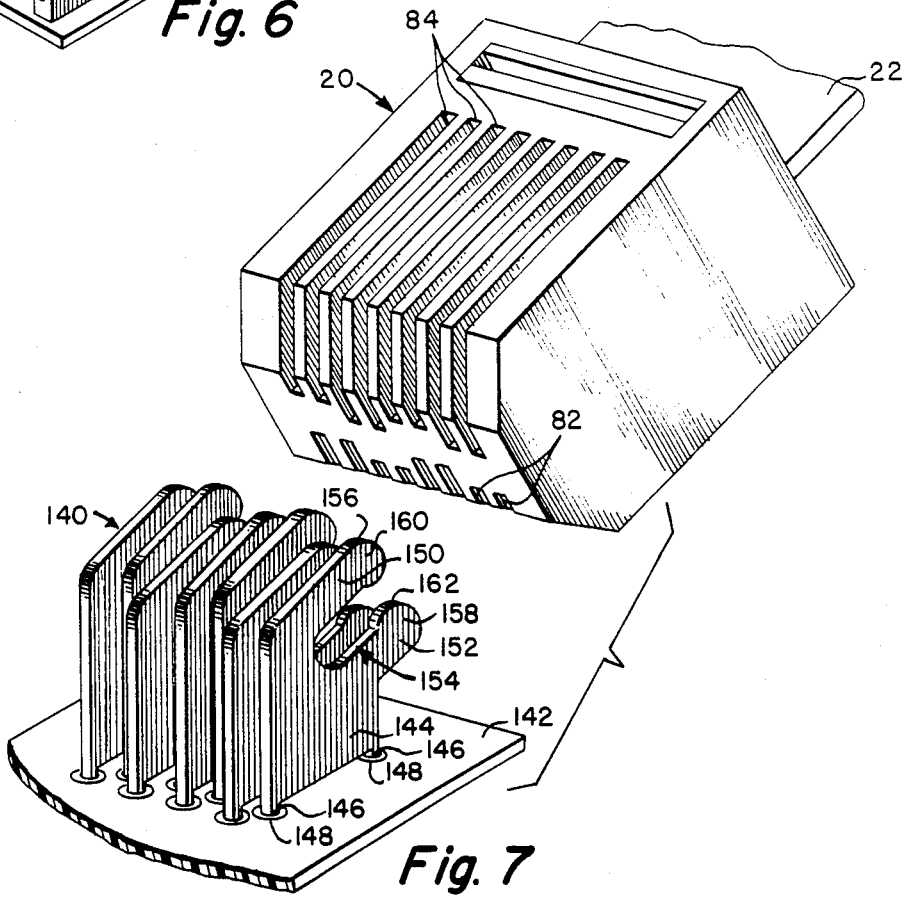
FIG. 7 is a diagrammatic illustration of the connector of FIGS. 1, 3 and 4 in which a prestamped contact is substituted for the wireform, with the edges of the prestamped contact formed at the inwardly protruding ends of the U-shaped channel in the stamping providing an insulation displacing function.
Figure 8:
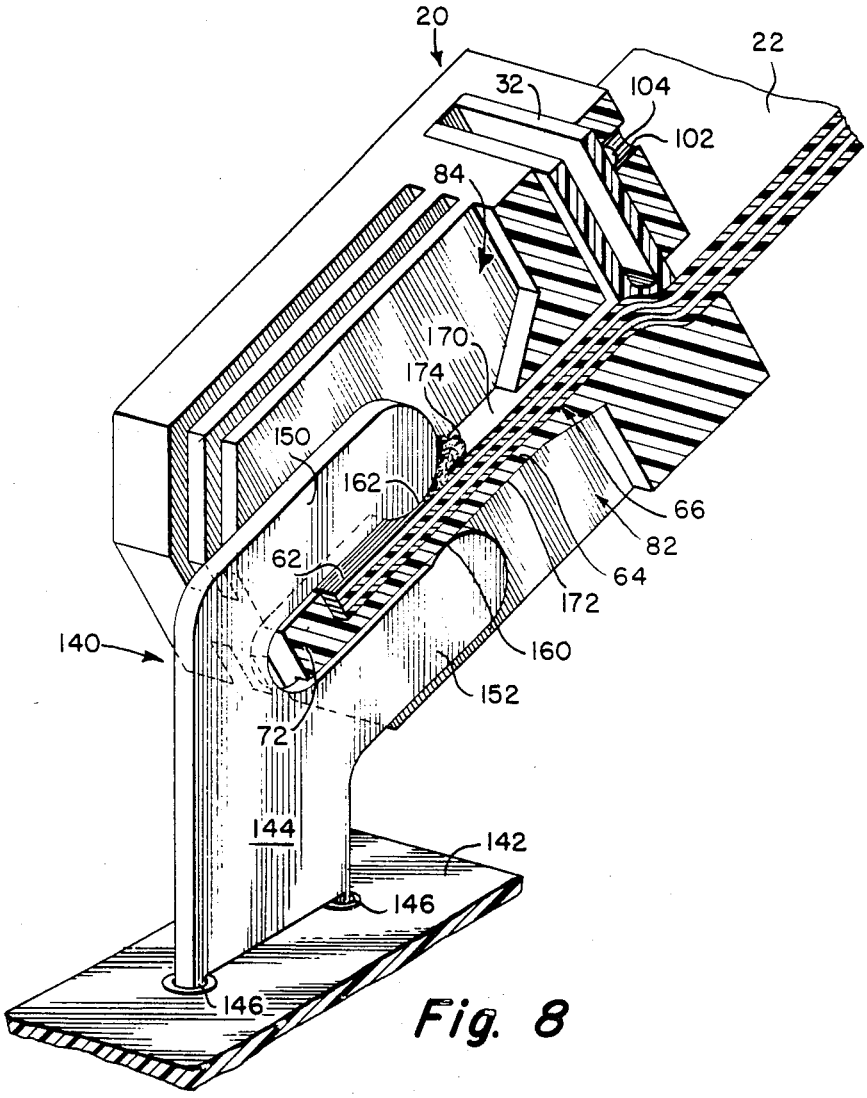
FIG. 8 is a sectional and diagrammatic illustration of a portion of the connection system of FIG. 7 illustrating the insulation displacement provided by the stamped contact.

Referring now to FIG. 7, connector housing 20 of FIGS. 1, 3, 4 and 6 may be provided in combination with prestamped contacts 140 which are mounted to a substrate 142 in the same offset manner as illustrated in FIG. 4. In this case, however, the contacts are in the form of prestamped pieces having a base 144 with leads in the form of legs 146 extending through apertures 148 in support 142. Extending outwardly from base 144 are two contact arms 150 and 152 which define a U-shaped channel 154 therebetween. Ends 156 and 158 of the contact have inwardly protruding portions 160 and 162 for the purpose of not only making contact with the conductors of cable 22 but also for the purpose of displacing insulation as illustrated in FIG. 8. Prior to referring to FIG. 8, it will be appreciated that the prestamped contacts align with the associated contact-receiving slots or channels 82 and 84 in connector body 20 in the same manner as the wireform contacts of FIG. 4 align with similar slots in the connector body. It will also be appreciated that while in the FIG. 7 embodiment the U-shaped portions of the connectors have inwardly protruding portions 160 and 162 due to the stamping, so too could the wire forms of FIG. 4 be provided with end portions which project inwardly to increase contact pressure.

Referring now to FIG. 8, with cable 22 inserted into cable insertion channel 66, it will be appreciated that initially the outer layer or skin 170 of cable 22 is not stripped away in the area of conductor 62. Rather the insulation corresponding to layer 170 is displaced by inwardly protruding portion 162 of contact 140 as contact 140 is forced into the connector body such that inwardly protruding portion 160 contacts the bottom surface 172 of shelf 64 immediately opposite the point at which portion 162 contacts and displaces layer 170. The displacement of layer 170 is illustrated at 174 to be pushed ahead of portion 162.

The same advantages associated with the connector housing described in connection with FIGS. 1–6 apply equally well to the embodiment shown in FIGS. 7 and 8, with the only difference being that the contact may be fabricated from a preformed stamping which has been mounted into the appropriate support or base.

With the use of a stamping, it will be appreciated that the gap between the ends of the contact may be made narrower than is the case with wireforms, since the stiffness of the wireform is significantly less than that associated with a prestamped contact which has been stamped from a sheet of metal, preferably of beryllium copper. Thus, while in the wireform embodiment, shelf 64 serves to permit the utilization of less stiff wireforms, in the embodiments of FIGS. 7 and 8 involving stampings, shelf 64 provides a relatively tough surface for portion 160 to bear on, which is opposite the portion of the cable to be stripped or displaced. Were it not for shelf 64, the effect of the insertion of contact 140 into connector housing 20 would be the double-sided displacing of the insulation surrounding the cable. While this may be desirable in certain applications, it is undesirable in others. Thus, shelf 64, when used, protects the opposite side of the cable from displacement of the insulation layer. Should double-sided insulation stripping be desired, then the depth of vertical slot 82 may be increased so that portion 160 rather than riding on shelf 64, rides on the bottom cable layer, thereby to displace it as well as the top layer.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A connection system for use with a flat cable having conductors located on a narrow pitch comprising:

a substrate having offset apertures therein;

female contacts having leads extending into associated apertures in said substrate and electrically and mechanically coupled thereto, each of said female contacts having a U-shaped forward portion having two spaced apart contact arms, said contacts being located on a pitch corresponding to the pitch of the conductors in said cable; and a monolithic connector housing having opposed ends, and opposed upper and lower outer surfaces, said monolithic connector housing having an integral generally planar flat cable insertion channel disposed along a first plane centrally therein, in open communication with one end thereof that extends internally of and terminates within said housing at an abutment that limits placement of said flat cable, said cable insertion channel adapted to receive by movement through said one end of said housing an end of said flat cable that is inserted into said monolithic connector housing the end of which cable terminates generally internally thereof proximate said abutment, said housing having integral walls defining plural vertically displaced opposing pairs of contact-receiving slots in open communication with the other end thereof, with each of said vertically displaced pairs of contact-receiving slots disposed along a second common plane generally transverse said first plane and such that respective ones of said slots of said opposing pairs of slots are disposed to either side of said first plane, said walls defining said contact-receiving slots of said pairs of slots being integrally formed in said monolithic connector housing in such a way that they are laterally spaced in a direction defined by the normal to each of said second planes and along said other end with respective ones of said vertically displaced pairs being in open communication with a corresponding one of said upper and lower outer surfaces, said contact-receiving slots of said plural opposing pairs of slots are located on a pitch corresponding to the pitch of the conductors in said cable, one contact-receiving slot of each of said pairs in open communication with said cable insertion channel internally of said monolithic connector housing, with the opposing contact-receiving slot of each of said pairs stopping short of communication with said channel defining a corresponding shelf portion between said opposing one of each of said pairs and an inserted cable, said shelf providing a predetermined thickness to the cable, the contact arms of each of said female contacts adapted to be inserted into associated vertically displaced and directly opposed contact-receiving slot pairs, such that one arm contacts an exposed conductor on one side of said cable, whereas the opposing arm of an associated female contact is positioned to directly contact the side of an associated one of said shelves away from said conductor.

2. The connection system of claim 1 and further including means for retaining said cable in said housing.

3. The connection system of claim 2 wherein said retaining means includes a laterally running slot in said housing and a strain relief member adapted to be inserted in said laterally running slot, said laterally running slot communicating with said cable introduction channel, said strain relief member having a laterally running edge such that when said strain relief member is inserted in said laterally running slot said laterally running edge presses laterally across said cable to secure said cable in said channel.

4. The connection system of claim 3 wherein said strain relief member has a U-shaped cross-section providing two flexible sides, one of said sides including a detent, the wall of said laterally running slot including a corresponding aperture such that when said strain relief member is inserted into said laterally running slot said detent resides in said aperture for securing said strain relief member in said laterally running slot.

5. The connection system of claim 4 wherein said cable insertion channel includes two levels having a shoulder therebetween adjacent said laterally running slot, the lateral edge of said strain relief member configured to conform to said shoulder and running in the same direction as said shoulder.

6. The connection system of claim 1 wherein said female contacts are wireform connectors.

7. The connection system of claim 1 wherein said female contacts are prestamped from metal sheets.

8. The connection system of claim 7 wherein said prestamped female contacts have inwardly directed protrusions at the ends of said arms at the forward portions of said contacts, said protrusions projecting towards the center line of said U-shaped portion.

9. The connection system of claim 8 wherein said cable has an insulating cover layer over its conductors and wherein one of said protrusions strips the cover layer of said cable away from an associated conductor of a cable inserted into said cable insertion channel when the associated female contact is inserted into the associated vertically displaced contact-receiving slot pair, thereby to provide an insulation displacing system , the opposite protrusion bearing on the surface of said shelf away from the associated conductor such that one arm of said contact grips the conductor exposed by displacement of said cover layer and such that the other arm of said contact grips a portion of said connector housing, whereby in said insulation displacing system said shelf serves to protect the nonconductor surface of said cable.

10. The connection system of claim 1 wherein laterally adjacent pairs of contact-receiving slots run to the same depths within said connector housing thereby to accommodate pairs of conductors in the associated flat cable.

11. The connection system of claim 1 wherein selected ones of said slots in communication with said channel internal of said monolithic housing of said vertically disposed pairs of contact-receiving slots are defined both above and below said first plane in a preselected laterally offset pattern selected to allow contact of both sides of said flat cable by associated ones of said opposing contact arms.

12. The connection system of claim 1 wherein said shelf is provided above or below an inserted cable depending on which of the slots of the pair has the shallower depth.

* * * * *